US005429273A

United States Patent [19]

King et al.

[11] Patent Number: 5,429,273

[45] Date of Patent: Jul. 4, 1995

[54] APPARATUS FOR DISPENSING FLOWABLE MATERIALS FROM A POUCH

[75] Inventors: David C. King, Bath; Ralph C. Wirsig, Kingston, both of Canada

[73] Assignee: Du Pont Canada Inc., Mississauga, Canada

[21] Appl. No.: 205,759

[22] Filed: Mar. 4, 1994

Related U.S. Application Data

[63] Continuation of Ser. No. 945,645, filed as PCT/CA91/00140, Apr. 26, 1991, abandoned.

[30] Foreign Application Priority Data

May 2, 1990 [GB] United Kingdom ..... 9009846

[51] Int. Cl.[6] ..... B65D 5/00

[52] U.S. Cl. ..... 222/82; 222/83.5; 222/88; 222/89; 222/91; 222/95; 222/105; 222/326

[58] Field of Search ..... 222/81, 82, 83, 83.5, 222/88, 89, 91, 95, 105, 325, 326, 386

[56] References Cited

U.S. PATENT DOCUMENTS

| | | | |
|---|---|---|---|
| 3,193,146 | 7/1965 | Isgriggs et al. | 222/82 |
| 3,333,737 | 8/1967 | Molineux | 222/91 |
| 4,265,372 | 5/1981 | Wainberg | 222/82 |
| 4,880,125 | 11/1989 | LeBeau | 222/326 X |
| 4,907,722 | 3/1990 | Ueda et al. | 222/83 |
| 5,154,321 | 10/1992 | Shomer | 222/386 X |

*Primary Examiner*—Andres Kashnikow
*Assistant Examiner*—Joseph A. Kaufman

[57] ABSTRACT

A dispenser of flowable materials from a pouch is disclosed. The pouch has an ear (55) at each of the ends of a transverse seal (53) located at one end of the pouch (57). The dispenser comprises i) a cylindrical container (33) having sides and an open top having a rim, the container being adapted to contain the pouch, and ii) a lid (35) attachable to the rim such that the lid is adapted to trap the ears of the pouch between the lid and the rim and to keep said end of the pouch taut between the ears when the lid is attached to the rim. The lid is also being adapted to allow a spout (41) to pierce the pouch at the taut portion.

3 Claims, 6 Drawing Sheets

APPARATUS FOR DISPENSING FLOWABLE MATERIALS FROM A POUCH

This is a continuation of application Ser. No. 07/945,645 filed as PCT/CA91/00140, Apr. 26, 1991, now abandoned.

BACKGROUND OF THE INVENTION

The present invention relates to an apparatus for dispensing flowable materials from a pouch. The pouches are pillow-shaped with "ears".

It is well known to package flowable materials, for example, milk, on so-called vertical form and fill machines. Using such a machine, a flat web of synthetic thermoplastic film is unwound from a roll and formed into a continuous tube in a tube forming section, by sealing the longitudinal edges of the film together to form a so-called lap seal or a so-called fin seal. The tube thus formed is pulled vertically downwards to a filling station. The tube is then collapsed across a transverse cross-section of the tube, the position of the cross-section being at a sealing device below the filling station. A transverse heat seal is made, by the sealing device, at the collapsed portion of the tube, thus making an airtight seal across the tube. The sealing device generally comprises a pair of jaws. After making the transverse seal, but before the jaws of the sealing device are opened, a quantity of material to be packaged, e.g. liquid, is caused to enter the tube, at the filling station, and fill the tube upwardly from the aforementioned transverse seal. The tube is caused to move downwardly a predetermined distance. Such movement may be under the influence of the weight of the material in the tube, or may be caused by pulling or mechanically driving the tube. The jaws of the sealing device are closed again, thus collapsing the tube at a second transverse section. The second transverse section may be above, usually just above, the air/material interface in the tube, or the second transverse section may be below the air/material interface. The sealing device seals and severs the tube transversely at the second transverse section. The material-filled portion of the tube is now in the form of a pillow shaped pouch. Thus the sealing device has sealed the top of the filled pouch, sealed the bottom of the next-to-be formed pouch, all in one operation. One such vertical form and fill machine of the type described above is sold under the trade mark PREPAC. With some other machines, the sealing device does not sever the tube at the second transverse section, but does sever the tube subsequently. With some machines the filling of the tube is done continuously rather than intermittently. The portions of the pouch at the ends of the transverse seals are often referred to as "ears".

For many years, milk has been packaged in pouches made on vertical form and fill machines. Such pouches have been sold to household consumers and, in use, such milk-filled pouches are stood within an open-mouthed pitcher. More recently, such pouches have been used to package other flowable comestibles, mayonnaise, salad dressings, preserves and the like. Pouches containing such comestibles are usually sold to "institutional" buyers, e.g. restaurants. Heretofore the flowable materials have been removed from such pouches by cutting an ear of the pouch and pouring or squeezing the flowable material out of the pouch. Alternatively the pouch has been fitted with a pouring spout such as that disclosed in Canadian Patent 1 192 164 to L. Obidniak. The present invention provides an alternate apparatus for removing flowable material from a pouch.

SUMMARY OF THE INVENTION

Accordingly the present invention provides an apparatus for removing flowable material from a pouch, said pouch having an ear at each of the ends of a transverse seal located at one end of the pouch, said apparatus comprising i) a tubular container having sides and an open top having a rim, said container being adapted to contain said pouch, ii) a lid attachable to the rim such that the lid is adapted to trap the ears of the pouch between the lid and the rim and to keep said end of the pouch taut between said ears when said lid is attached to the rim, said lid also being adapted to allow a spout to pierce said pouch at said taut portion.

In one embodiment the tubular container has a bottom comprising a piston disk adapted to move towards the top of the container.

In a further embodiment the lid is hingedly attached to the container.

In yet another embodiment the lid is separate from the container and attachable to the rim with a snapfit closure.

In another embodiment the lid is separate from the container and attachable to the rim with a quick locking closure.

In a further embodiment the container has a bottom rim, and a bottom which is detachable from said bottom rim, said pouch having ears at both ends of the pouch, and said bottom is adapted to trap at least one ear of the pouch between the bottom and the bottom rim, said container, when assembled with pouch, bottom, lid and spout, being substantially gas-tight, and said container having means to allow gas to enter said container.

In yet another embodiment the tubular container has a cross-section which is essentially square, with rounded corners.

The invention also provides a kit for making an apparatus for removing flowable material from a pouch, said pouch having an ear at each of the ends of a transverse seal located at one end of the pouch, said kit comprising i) a cylindrical tube having a bottom rim and a top rim, and ii) a lid attachable to the top rim such that the lid is adapted to trap the ears of the pouch between the lid and the top rim and to keep said end of the pouch taut between said ears when said lid is attached to the top rim. Optionally the kit has a bottom which is adapted to attach to a bottom rim of the tube.

In another embodiment the kit additionally contains a spout adapted to pierce the taut portion of the pouch.

In a further embodiment the bottom is integrally attached to the bottom rim of the container.

In another embodiment the bottom has associated therewith a piston disk and piston rod adapted to push said pouch towards the lid when the kit is assembled.

In yet another embodiment the lid is adapted to permit attachment of the spout thereto.

In a further embodiment the spout has a valve associated therewith.

In another embodiment the spout is adapted to have fitted thereto a nozzle.

In yet another embodiment the cylindrical tube has a cross-section which is essentially square, with rounded corners.

BRIEF DESCRIPTION OF THE DRAWINGS

The invention may be more readily understood by reference to the drawings in which.

Figure 2:
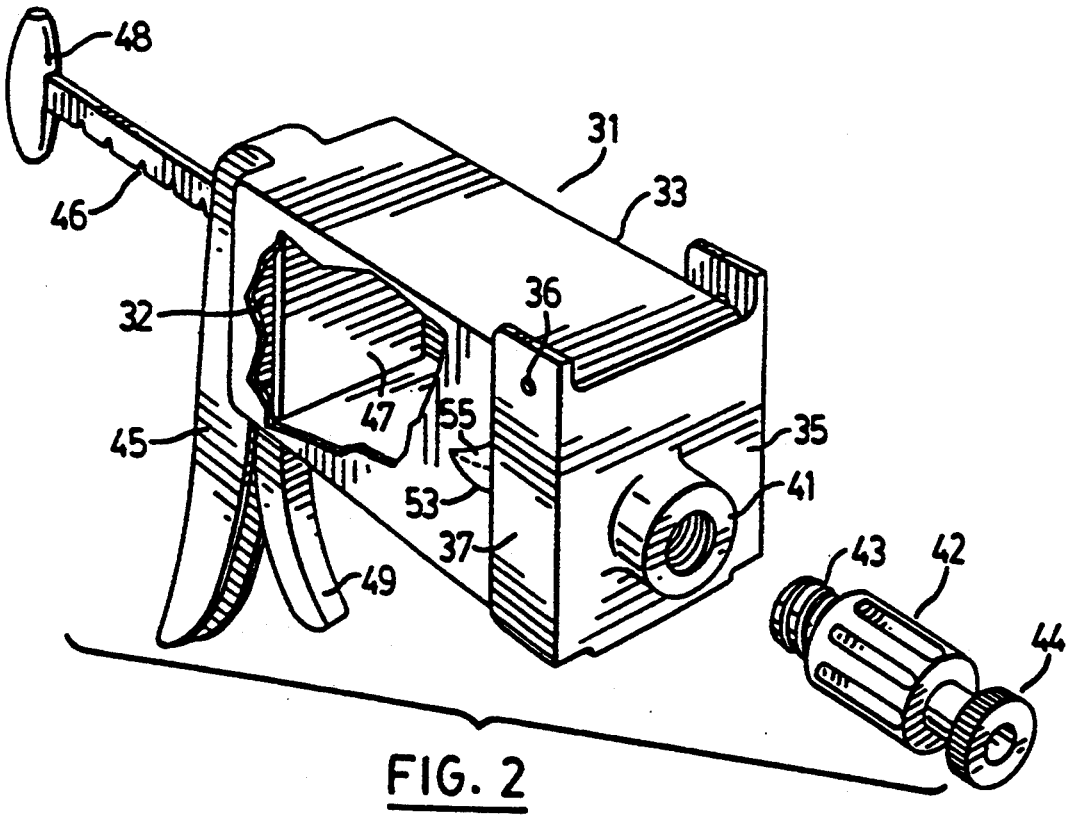
FIG. 2 shows a three quarter view, partly cut away, of another container of the present invention, said container having a hinged lid and a detachable spout.
Figure 3A:
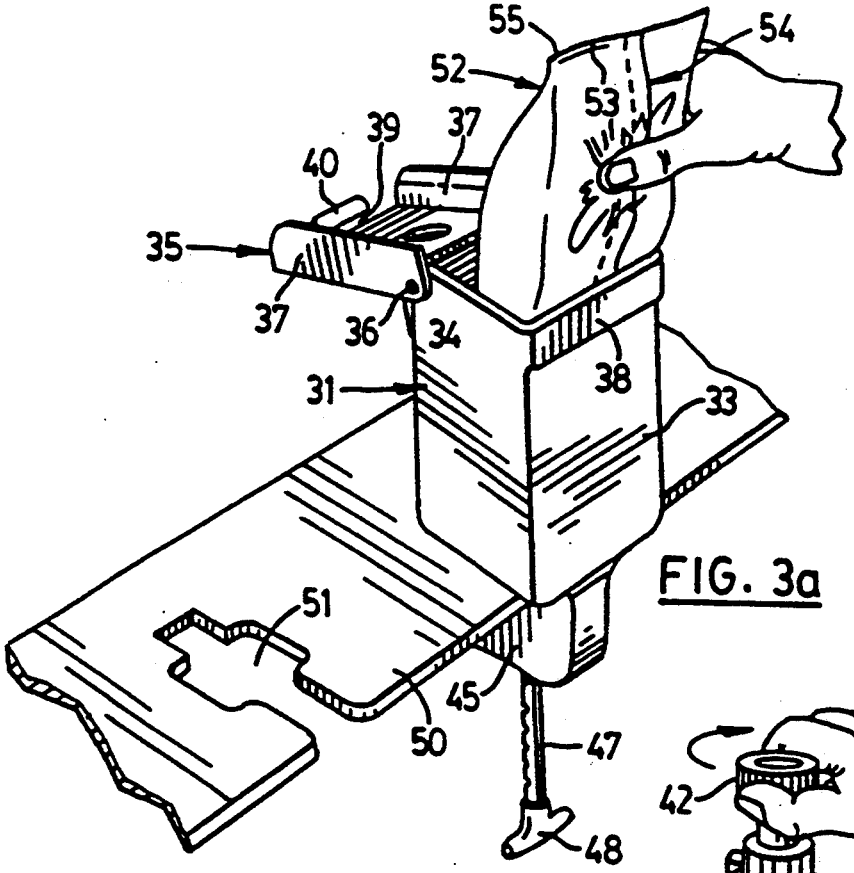
Figure 3C:
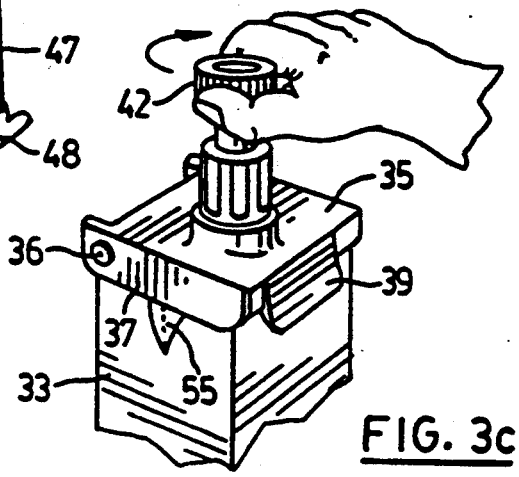
Figure 3B:
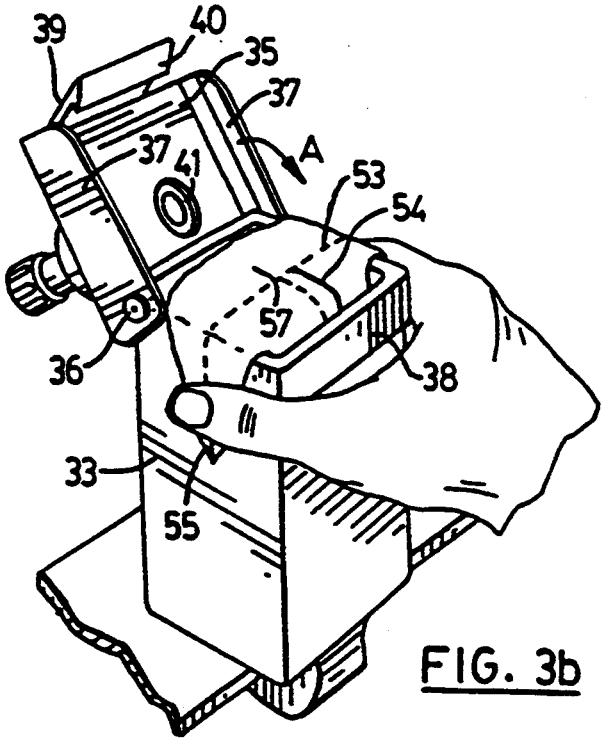
Figure 3D:
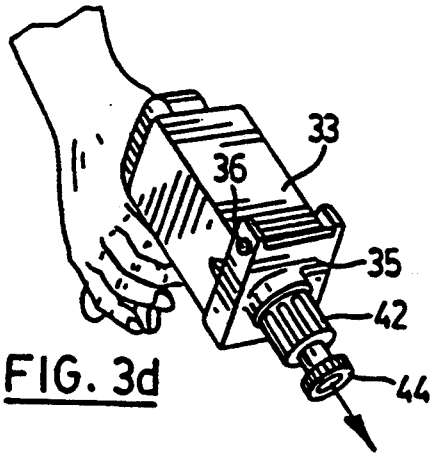

FIGS. *3a, 3b, 3c* and *3d* show a manner of using the container of FIG. 2.

Figure 4:
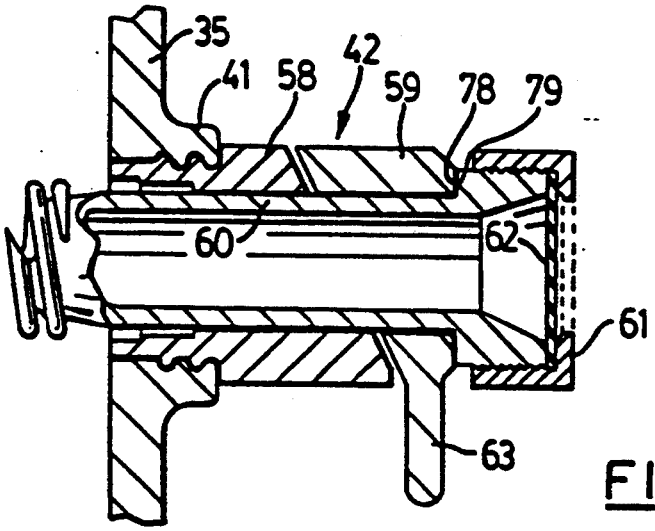

FIG. 4 shows a spout, in cross-section, which may be used in conjunction with the container of FIG. 2.

Figure 5:
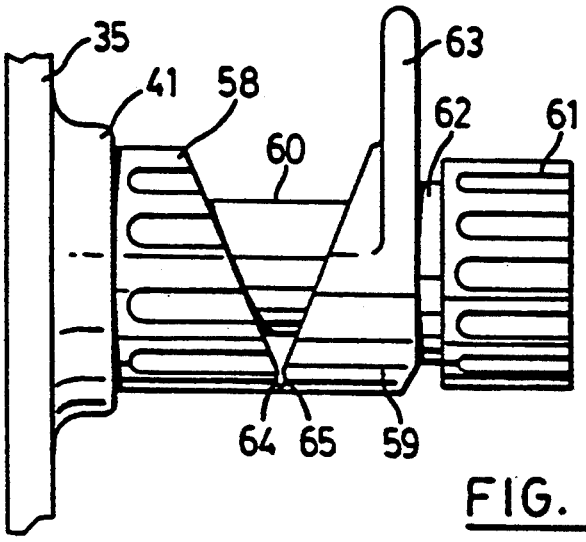

FIG. 5 shows the spout of FIG. 4 in a different mode of operation.

Figure 6:
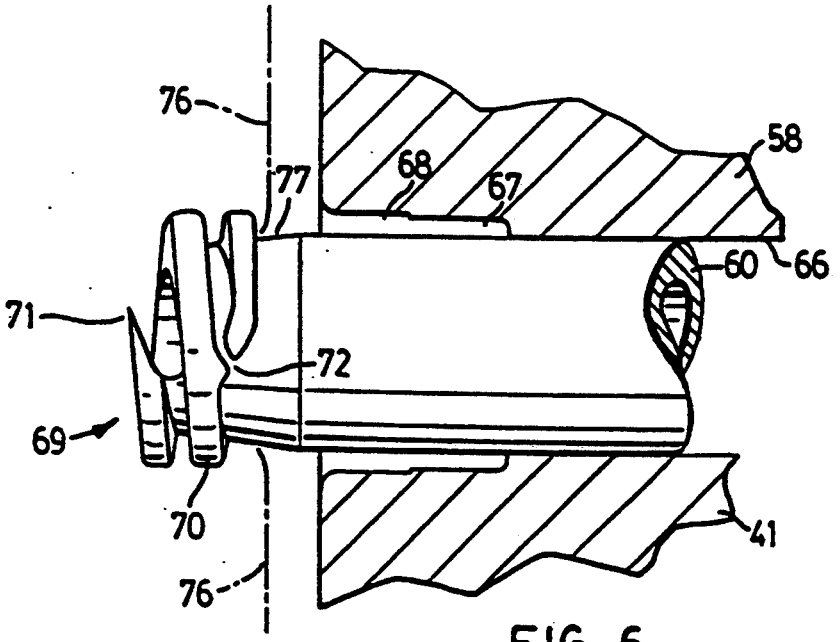
Figure 8:
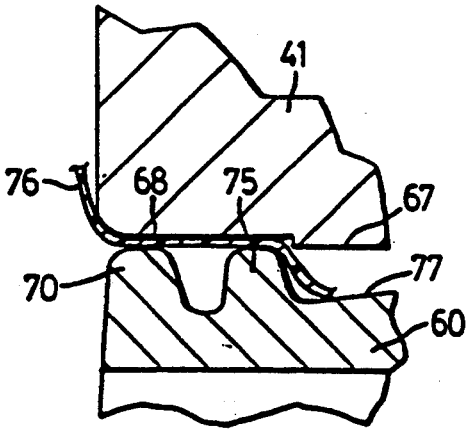
Figure 7:
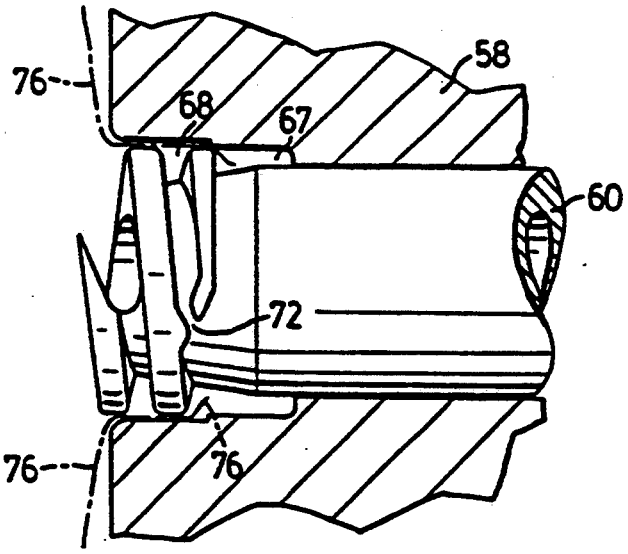

FIGS. 6, 7 and 8 show details of the piercing end of the spout shown in FIGS. 4 and 5.

Figure 9:
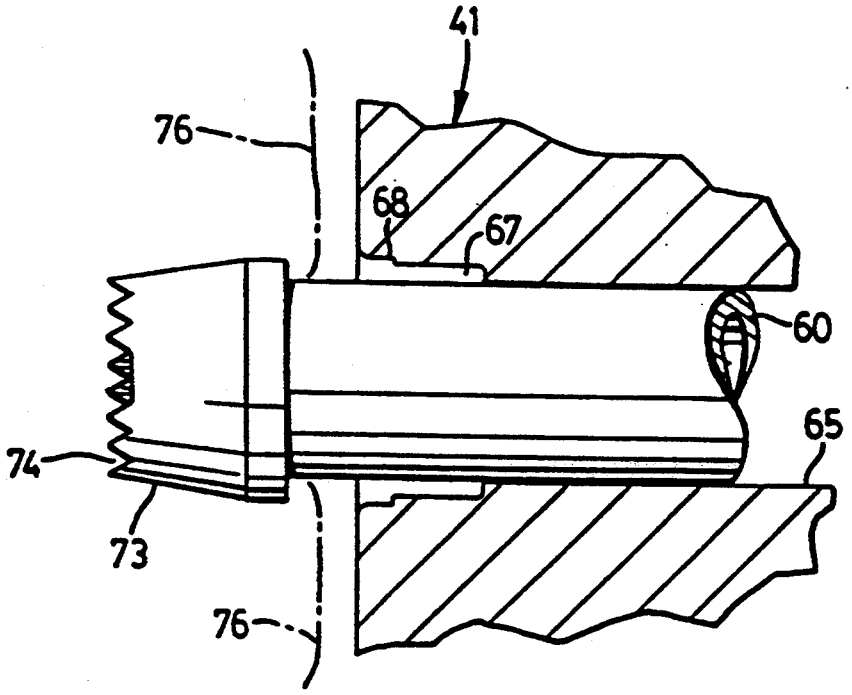

FIG. 9 shows another spout, in cross-section, which may be used in conjunction with the container of FIG. 2.

Figure 10:
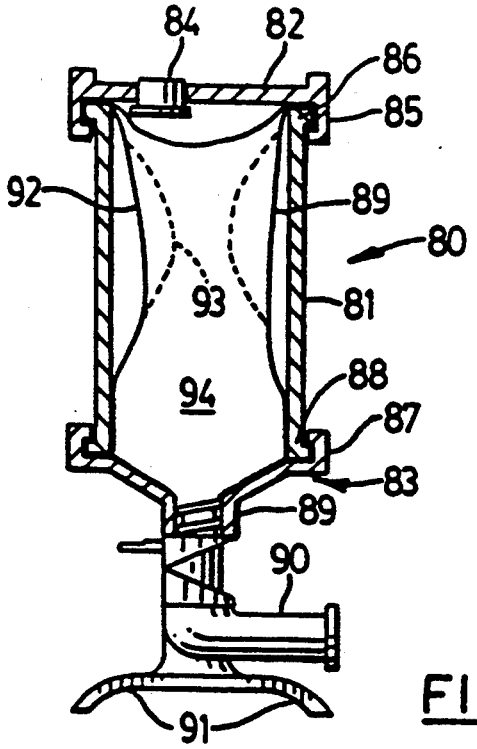
Figure 11:
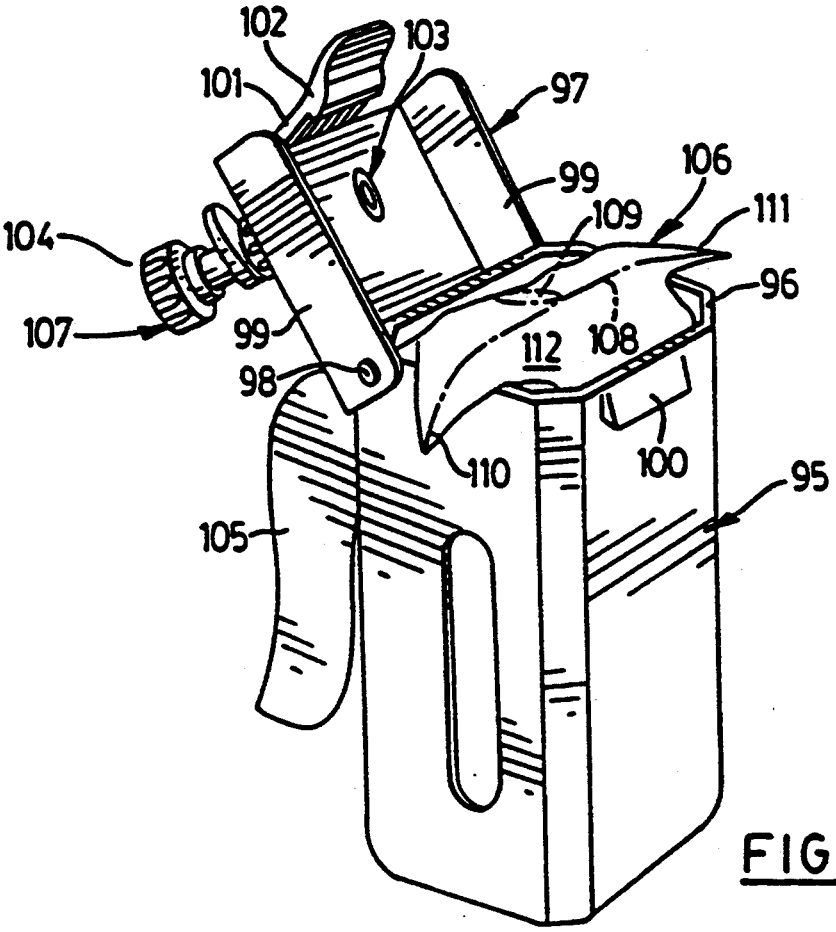

FIGS. 10 and 11 show other containers of the present invention.

DETAILED DESCRIPTION OF THE PREFERRED EMBODIMENT

Figure 1:
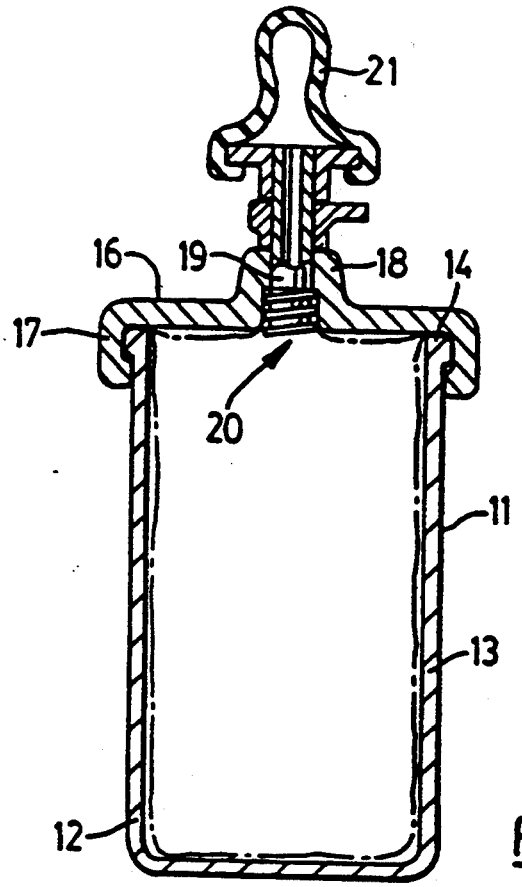
FIG. 1 shows a container of the present invention in cross-section.

FIG. 1 shows a system suitable for dispensing baby formula from a pouch. The system comprises a container 11 having a bottom 12 joined integrally to cylindrical tube 13. Cylindrical tube 13 has a top rim 14 with an outwardly extending lip 14. Detachably attached to the rim is lid 16 which has a skirt 17 adapted to snap-fit over lip 14. In lid 16 located off-centre is attached or joined a conduit 18 to which is attachable, by means not shown, a spout 19. Spout 19 has, at the end facing inside the container, a piercing end 20 which is adapted to pierce the film (not shown) from which the pouch (not shown) is made. The other end of the spout has a nipple 21 attached thereto. Bottom 12 is not essential. Cylindrical tube 13 should be long enough to allow the pouch, which hangs by ears which are trapped between rim 14 and lid 16, to be held taught between the ears so that the film of the pouch is relatively easily punctured by piercing end 19.

FIGS. 2 and *3a* show a system suitable for dispensing sour cream, mayonnaise and the like from a pouch. The system comprises container 31 having a bottom 32 joined integrally to tubular container 33. Tube 33 has a top rim 34. Tube 33 may have a variety of cross-sections including circular or rectangular cross-sections as shown in FIG. 2. Lid 35 is attached to tube 33 by hinge post 36. Lid 35 also has side skirts 37. Tube 33 also has a transverse lip 38 on the side of the cylindrical tube furthest away from hinge posts 36. Lid 35 has a tab 39 with a latching piece 40 attached thereto. Latching piece 40 is adapted to latch under transverse lip 38 when lid 35 is closed as shown in FIG. *3c*. A threaded conduit 41 is joined to lid 35. Into conduit 41 may be inserted spout 42 which has a threaded end 43 and a nozzle 44. Threaded end 43 is for screwing into the threaded portion of conduit 41. Bottom 32 has a handle 45 joined thereto. In the base of the handle and through bottom 32 passes ratcheted spindle 46. Spindle 46 is attached, inside cylindrical tube 33, to piston disk 47. At the end of spindle 46, distal to disk 47, is attached T-handle 48. Trigger 49 is attached to a pawl (not shown) so that spindle 46 may be moved, and thus piston disk 47 be advanced towards lid 35.

The operation of the container of FIG. 2 for dispensing material is described more fully by reference to FIGS. *3a* to *3d*. Container 31 is placed upright in rack 50 having a cut-out 51 adapted to aid in holding container 31 upright. Container 31 is held upright by means of bottom 32 being flush with the upper surface of rack 50, i.e. stands on rack 50 under the influence of gravity. Lid 35 is opened as shown in FIG. *3a*. Pouch 52 of flowable material, e.g. sour cream, has two transverse end seals, one of which is shown as 53. The pouch is made from a flat web of thermoplastic polymeric material, e.g. polyethylene, and formed longitudinally into a tube. In the embodiment shown in FIG. *3a* the tube is sealed with a longitudinal seal 54 and then transversely sealed with seals 53. The transverse seal forms "ears" 55. As shown in FIG. *3a*, pouch 52 is dropped into container 31. The ears of the pouch 55 and 56 are stretched over the top rim 34 of cylindrical tube 33 as shown in FIG. *3b*. Lid 35 is swung over, following arrow A in FIG. *3b* until latching piece 40 of tab 39 engages with transverse lip 38. Lid 35 then firmly grips ears 55 and 56 and traps them between rim 34, skirts 37 and lid 35 as shown in FIG. *3c*. Thus the top 57 of pouch 52 is held taut between ears 55 and, 56. The pouch itself is filled so that the contents are not under pressure. In the embodiment shown in FIG. *3c*, spout 42 is already attached to conduit 41. Conduit is off-centre in the lid so that the nozzle 44 does not sit over the longitudinal seal 54 or the transverse seal 53. By twisting nozzle 44 the pointed end of the threaded end or the saw-toothed end of spout is caused to penetrate the taut portion of the top 57 of pouch 52. Because the pouch is not under pressure, the contents of the pouch remain within the pouch without leakage. If the pouch was under pressure there would be a danger of the contents squirting out into the interior of container 33. By a mechanism and process described hereinafter the threaded end or saw-toothed end of the spout is sealed to the pouch so that material does not spill into the container. The container, with pouch therein is then ready for use. The threaded-end type spout is preferred for films which are less stretchy, e.g. polyethylene films laminated to ethylene-vinyl alcohol copolymer films. As shown in FIG. *3d*, the dispenser may be grasped by hand using handle 45. In order to force material from the pouch, trigger 49 is manually squeezed, thus causing the ratchet mechanism to mote piston disk 47 towards lid 35 and squeeze material from the pouch through spout 42 and nozzle 44 as a result of the hydraulic pressure within the pouch.

A spout which might be used in the dispenser shown in FIGS. 3 is shown more clearly, in cross-section, in FIGS. 4 and 5. Lid 35 has a threaded conduit 41 therein. Spout 42 comprises ramped sleeve 58 with ramped lever 59, nozzle 60, diffuser 62 and diffuser retaining cap 61. Nozzle 60 has a corkscrew tip 69 attached distal to diffuser retaining cap 61. Diffuser retaining cap 61 may be blind or may have a variety of diffusers 62 associated therewith. The type of diffuser will depend on the type of material being dispensed. If, for example, the material is mayonnaise, the diffuser may be in the shape of a disc with a multiplicity of holes from 3 to 6 mm in diameter therein, for larger discharge onto, for example, hamburger buns. Cross-shaped slits may be used in diffuser 62 for sour cream or the like. Diffuser 62 is conveniently made from discs of neoprene or polyester sheet. Ramped lever 59 has a handle 63 attached thereto for assisting in rotation of ramped lever 59. Ramped sleeve 58 and ramped lever 59 each have a detent 64 and 65 respectively for holding ramped sleeve and lever in place in the position shown in FIG. 5. Ramped sleeve 58 is threadedly engaged in threaded conduit 41.

FIGS. 6 to 8 show details of the spout of FIGS. 4 and 5. In these Figures the nozzle 60 has at its end a corkscrew tip 69 which has a thread 70 ending in a piercing tip 71. Ramped sleeve 58 forms a bore 66 for the insertion and retention of nozzle 60. The end of bore 66, distal to diffuser 62, has a widened bore 67 and an even wider bore 68. The thread 70 has an outside diameter of slightly less than the diameter of bore 68, and is essentially "zero clearance" with respect to bore 67. For example widened bore 67 may be about 12.5 μm greater in diameter than the outer diameter of the threads. For use with a pouch having a film thickness of about 76 μm, bore 68 should be about 76 to 100 μm wider in diameter than the outer diameter of threads 70. Thread 70 has a constricted end 72. In operation, nozzle 60 is first retracted so that threads 70 are at least within bore 68. Corkscrew tip 69 should be withdrawn into bore 67 so that the piercing tip 71 do not accidentally snag the pouch and pierce it. Then lid 35 is closed in such a way as to trap the pouch ears 55 and 56 against top rim 34 and keep portion 57 of the pouch taut. Nozzle 60 of spout 42 is then twisted and pushed in such a manner that piercing tip 71 pierces film 76 in taut portion 57. Corkscrew tip 69 thus punctures film 76. Corkscrew tip 69 is gradually worked, by twisting, into pouch 52 until the film 76 is snugly adjacent tapered portion 77 of nozzle 60, as shown in FIG. 6. Handle 63 of ramped lever 59 is then twisted until detents 64 and 65 engage. The thrust on sliding surfaces 78 and 79 (shown in FIG. 4) cause nozzle 60 and therefore corkscrew tip 69 to be drawn away from pouch 42. As shown in FIGS. 7 and 8 corkscrew tip 69 is pulled towards bore 68 and film 76 is trapped between threads 70 and 75, and bore 68. The now film-covered threaded portion, 70 and 75, is pulled into bore 68 until the threads are prevented from moving further by the shoulder between bore 68 and narrower bore 67. Material is then prevented from leaking from pouch 42 by the mechanical seal formed by nipping film 76 between threads 70, 75 and bore 68, and by contraction of the film edge onto tapered portion 77. Constricted thread 72 which may be extended along the entire length of the threaded portion assists in preventing material in being extruded from the pouch through the seal area via the trough in the thread, although is not entirely satisfactory in the case of very runny liquids like water, if high pressure is applied by piston disc 47. In such a case, however, a different arrangement would be selected. Material inside pouch 42 may then be removed by extruding the material through the bore of nozzle 60. In the case of the saw-toothed end shown in FIG. 9, the relative lengths of bore 67 and bore 68 are determined by the length of the saw-tooth portion. The numerals in FIG. 9 relate to similar features in FIGS. 6 to 8 with the exception that the saw-toothed end is identified with numeral 73. Before the saw teeth 74 of saw-tooth portion 73 pierces the pouch, the saw-toothed portion 73 should be withdrawn into bore 67 so that the teeth 74 do not accidentally snag the pouch and pierce it when not required.

Another embodiment of the present invention is shown in FIG. 10. This container is more suitable for a container which is less portable than the containers shown in the other Figures and is useful for dispensing mustard, ketchup and like materials. The container is shown with its bottom uppermost and comprises a squeezable cylindrical tube 81 with a bottom 82 and a lid 83. Bottom 82 has therein a one-way air valve 84. Bottom 82 has a skirt 85 which is adapted to "snap" onto rim lip 86 of cylindrical tube 81 and farm a hermetic seal. Similarly lid 83 has a skirt 87 which is adapted to "snap" onto rim lip 88 of cylindrical tube 81. Lid 83 also has a conduit 89 leading to spout 90. The whole of container 80 is mounted on legs 91. Conduit 89 has associated therewith spout piercing means similar to that shown and described for the embodiment shown in FIGS. 2 to 8. Pouch 92 is held by at least one of its ears at the end of the pouch adjacent bottom 82 and by both ears at the end of the pouch adjacent lid 83. Spout 90 may have a valve (not shown) associated therewith, or a neoprene restrictor with a slit therein as is known in the trade. In operation, tube 81 is arranged with its rim 86 upwards. Then the material filled pouch 92 is inserted into cylindrical tube 81. Skirt 85 of bottom 82 is snapped onto rim 86, trapping at least one ear of the pouch therebetween. The partially assembled container is then arranged with rim 88 upwards and skirt 87 of lid 83 is snapped onto rim 88, trapping both ears of that end of the pouch, in a manner which ensures that the film between the ears is taut. The pouch 92 is pierced by the piercing means so that nozzle 90 is sealed into the pouch, much in the manner described in relation to FIGS. 4 to 8. The container 80 is then turned so that the spout 90 is at the bottom and product 94 is free to flow by gravity towards spout 90. Tube 81 may then be squeezed manually, thus applying pressure to the pouch. Material inside the pouch, 94, is thus caused to flow out of the pouch through spout 90. As tube 81 is released, air enters tube 81 via valve 84. Outline 93 shows the pouch after some of the contents 94 of the pouch have been emptied out.

FIG. 11 shows a container which is suitable for pourable liquids. As will be apparent it is very similar in construction and operation, inasfar as the spout mechanism is concerned, to the container of FIG. 3. Container 95 has an integral bottom (not shown) and a top rim 96. The bottom is not essential for the purpose of supporting the pouch but is obviously desirable in order to permit the container to stand on a table or the like without support. Lid 97 is attached to container 95 by hinge post 98. Lid 97 also has side skirts 99. Container 95 also has a transverse lip 100 on the side of the cylindrical tube furthest away from hinge posts 98. Lid 97 has a tab 101 with a latching piece 102 attached thereto. Latching piece 102 is adapted to latch under transverse lip 100 when lid 97 is closed. A threaded conduit 103 is joined to lid 97. Into conduit 103 may be inserted spout 104, which is in essential details similar to the ones shown in FIGS. 4 to 8. Container 95 has a handle 105 joined thereto. Spout 104 may have a blind cap 107 thereon.

In operation container 95 is placed upright. A pouch 106 of pourable material, e.g. milk, juice, which has two transverse end seals, one of which is shown as 108, a longitudinal seal 109 and ears 110 and 111, is dropped into container 95. The ears of the pouch 110 and 111 are stretched over the top rim 96 of container 95. Lid 97 is swung over until latching piece 102 of tab 101 engages with transverse lip 100. Lid 97 then firmly grips ears 110 and 111 and traps them between rim 96, skirts 99 and lid 97. Thus the top 112 of pouch 106 is held taut between ears 110 and 111. Conduit 103 is off-centre in the lid so that the nozzle 104 does not sit over the longitudinal seal 109 or the transverse seal 108. By twisting nozzle 104 the pointed end of the threaded end or the saw-toothed end of spout (not shown) is caused to penetrate the taut portion of the top 112 of pouch 106. By a mechanism and process described hereinbefore the threaded end or saw-toothed end of the spout is sealed to the pouch so that the pourable material does not spill into the container. The container, with pouch therein is then ready for use. As will be readily apparent the container may be grasped by hand using handle 105. After removing blind cap 107 from the spout 104 the container 95 may be tipped up so that pourable liquid may be dispensed through spout 104. After pouring sufficient liquid out of pouch 106 the container 95 is placed on its base and the cap reattached to keep the contents fresh.

The present invention is useful for dispensing flowable materials. The term "flowable material" does not include gases but encompasses materials which are flowable under gravity or may be pumped or extruded. Such materials include emulsions, e.g. ice cream mix; soft margarine; food dressings; pastes; preserves, e.g. doughnut fillings; jellies; detergents; and liquids, e.g. milk; oils. The dispenser of FIG. 1 is suitable, for example, for dispensing baby formula. The dispenser of FIGS. 2 and 3 is suitable, for portion control of products such as mayonnaise, ketchup, mustard, relish, sour cream, e.g. 28 ml portions of sour cream dispensed from a 680 ml pouch onto a taco. Using such a dispenser there is only about 1.25% wastage inside the pouch and another 1.25% wastage left in the nozzle neck. The dispenser of FIG. 10 is suitable, for example, for dispensing ketchup, mustard, mayonnaise, relish, sour cream, maple syrup, caramel, ice cream toppings. The dispenser of FIG. 11 is suitable for dispensing pourable liquids, e.g. juice, milk, liquid detergent.

We claim:

1. Apparatus for removing flowable material from a sealed pouch having a pair of spaced ears at one end of said pouch comprising:

(a) a housing having an open end defining a rim and adapted for holding said pouch;

(b) a lid releaseably securable to said rim so as to trap said ears of said pouch between said lid and said rim and present a taut portion of said pouch between said ears when said lid is secured to same rim;

(c) a spout associated with said lid, said spout including piercing means at one end of said spout to pierce said sealed pouch at said taut portion so that said flowable material remains in said pierced pouch during piercing, wherein said pierced pouch is pressed to said piercing means so as to minimize leakage of said flowable material around said piercing means, and wherein said spout includes a sleeve defining a bore for slidedly receiving a nozzle therein, said nozzle presenting said piercing means at one end thereof for piercing said pouch in a first position and nipping said pierced pouch between said piercing means and said bore in a second position so as to minimize leakage of said flowable material from said pouch around said piercing means.

2. Apparatus as claimed in claim 1 wherein said piercing means defines a saw-tooth tip.

3. Apparatus as claimed in claim 1 wherein said piercing means defines a corkscrew tip.

* * * * *